US006111706A

United States Patent [19]

Incera et al.

[11] Patent Number: 6,111,706

[45] Date of Patent: Aug. 29, 2000

[54] ADJUSTABLE LENS SUPPORT ASSEMBLY

[75] Inventors: Alex Incera, Pomfret, Conn.; Kent Seim, Muskogee, Okla.

[73] Assignee: Gerber Coburn Optical Inc., South Windsor, Conn.

[21] Appl. No.: 09/322,755

[22] Filed: May 28, 1999

[30] Foreign Application Priority Data

Jul. 9, 1998 [DE] Germany ..... 198 30 817

[51] Int. Cl.[7] ..... G02B 7/02

[52] U.S. Cl. ..... 359/822; 359/811; 359/819; 359/818

[58] Field of Search ..... 359/811, 819, 359/822, 818

[56] References Cited

U.S. PATENT DOCUMENTS 4,583,847 4/1986 Battig et al. ..... 355/53
4,609,285 9/1986 Samuels ..... 355/75

*Primary Examiner*—Georgia Epps
*Assistant Examiner*—Sared Seyrafi
*Attorney, Agent, or Firm*—Cantor Colburn LLP

[57] ABSTRACT

An adjustable lens support assembly retains and supports a lens in fixed registration during the manufacturing process. The lens support assembly includes a plurality of adjustable spring-loaded lens retainer pins that enable a plurality of lenses of various diameters to be maintained therein. The adjustable lens retainer pins, preferably three (3) pins, extend upward from a circular base having a tapered upper surface. A spacer supports the base above the lens support arm a predetermined distance to provide sufficient clearance to permit of the operation a mechanism to pivot simultaneously the lens retainer pins. A lens pad is centrally disposed on the base to support the lens. When the lens is placed in the lens support assembly, the concave surface of the lens engages the lens pad and the outer edges of the composite lens engage the adjustable lens retainer pins. Each lens retainer pin includes a lower pin portion and an upper pin portion. The upper pin portion is mounted eccentrically to the lower pin portion. A pivot mechanism interconnected to the upper pin portion of each lens retainer pin enable the user to simultaneously pivot the upper pin portions to vary the distance between the lens retainer pins to retain lens of varying diameter.

25 Claims, 6 Drawing Sheets

ADJUSTABLE LENS SUPPORT ASSEMBLY

BACKGROUND OF THE INVENTION

1. Field of the Invention

The invention relates to the field of eyeglass lens production. More particularly, the invention relates to a device for adjustably supporting lens blanks of varying diameters during a lens manufacturing process.

2. Prior Art

One method of producing ophthalmic or other types of lenses includes the process of laminating a front lens wafer and a back lens wafer together to form a composite lens. Each wafer is provided in a finished or polished form so as to provide selected optical properties in accordance with a desired lens prescription. This processing system combines and aligns selected front and back wafers so that the combined optical properties of the wafers form the prescribed lens. These lens wafers may be of varying material having a variety of pre-treatments, such as tinting and coating as examples. The lens wafers may also be formed of photochromatic material.

One such lens processing system allows quick delivery of high-quality progressive, single vision and flat top lenses, pre-coated with anti-reflective coating and/or a scratch resistance coating. The lens processing system has a clean air station including an alignment wheel that enables the user to properly align and combine the front and back lens to form the desired prescribed composite lens. To form the lens, a predetermined quantity of adhesive is applied between the front and back wafers, and the wafers are aligned in accordance with the requirements of a particular prescription. The composite lens is placed on a lens support assembly that includes a plurality of lens retainer pins to maintain the composite lens, having a predetermined diameter, in fixed registration to an air bag arm. The composite lens is then compressed between the lens support assembly and the air bag arm to spread the adhesive throughout the interface between the wafers and expel any bubbles disposed therebetween. Ultraviolet (UV) light is then used during the bonding process to cure the lens wafer adhesive.

Currently, wafers are provided in varying diameters, e.g. 67 and 75 mm diameter. The lens retainer pins of the lens support assembly, however, are spaced to retain a composite lens having one fixed diameter. This limits the use of such a lens processing system to produce composite lens having a single diameter. In order for a user to produce composite lenses of different diameters, the user would be required to change or swap the lens support assembly with another lens support assembly to retain a different diameter lens. Changing these support assemblies is time consuming and difficult. Moreover, the need to have multiple lens support assemblies increases the cost of the lens production system. For these reasons, the art is in need of an alternative lens support assembly which avoids the need to provide multiple support assemblies while concurrently also enabling the processing of composite lenses of varying diameters.

SUMMARY OF THE INVENTION

The above-identified drawbacks of the prior art are overcome or alleviated by the adjustable lens support assembly of the invention.

In accordance to the present invention, a lens support assembly is provided for retaining lens of varying dimensions, wherein the lens support assembly includes a lens support mounted to a base for supporting a lens thereon.

A plurality of lens retainer pins is mounted to the base for retaining the lens on the lens support. The lens retainer pins are spaced about the lens support for retaining the lens thereon. At least one of the lens retainer pins pivots about an eccentric pivot between a first position and a second position.

Preferably, each of the lens retainer pins are mounted pivotally to the base about a respective eccentric pivot to permit each pin to pivot between a first position and a second position. The lens support assembly may include a pivot mechanism to provide simultaneous pivoting of the lens retainer pins to enable the lens retainer pins to be adjusted for supporting lens of differing diameters. The pivot mechanism may also be spring-loaded to urge or clamp the lens retainer pins to the edges of the lens, and also center the lens on the lens support.

The objects and advantages of the present invention will become apparent in view of the following detailed description.

BRIEF DESCRIPTION OF THE DRAWINGS

Referring now to the drawings wherein like elements are numbered alike in the several Figures.

DETAILED DESCRIPTION OF THE INVENTION

Figure 1:
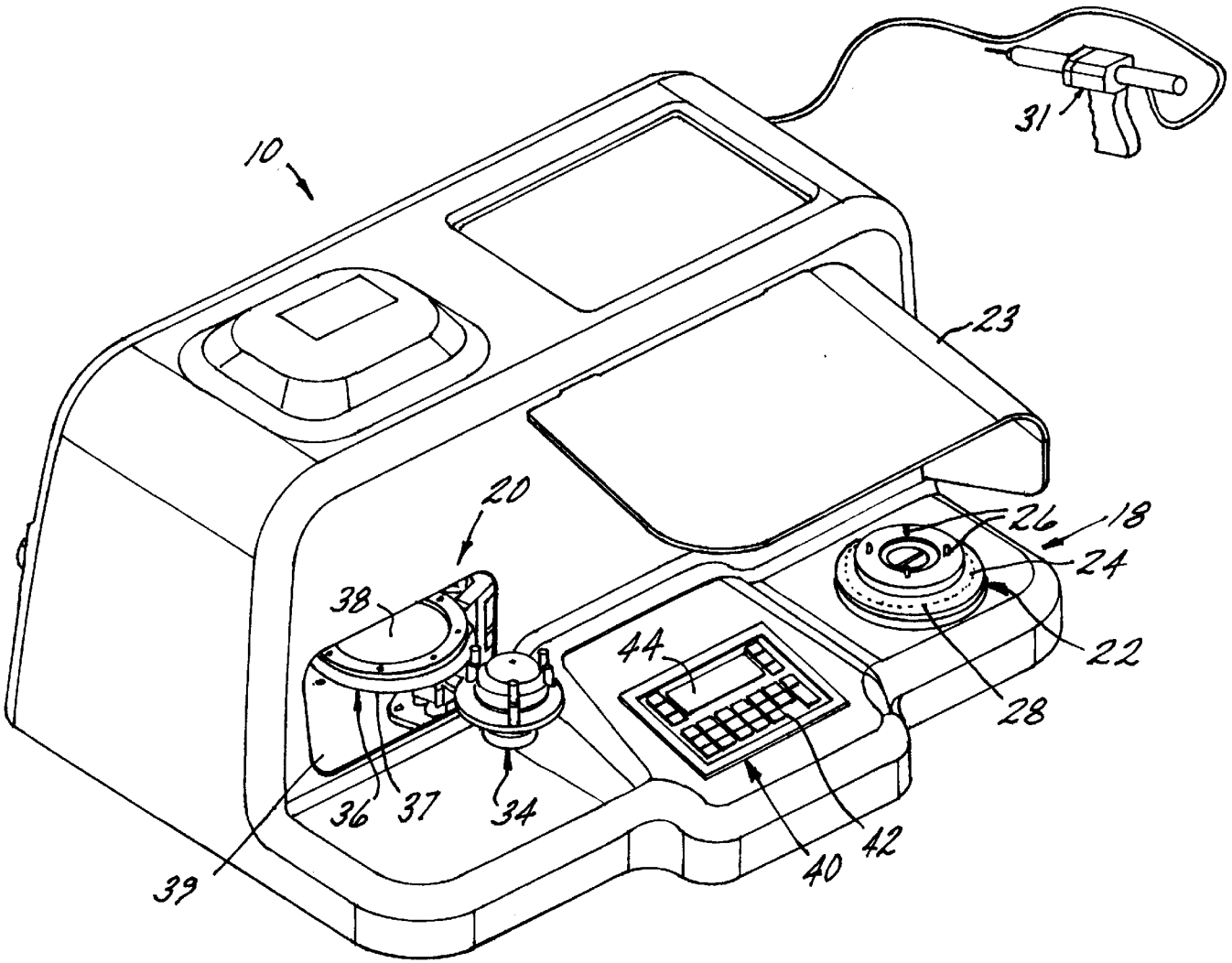
FIG. 1 is a perspective view of a lens processing system including a lens pad arm embodying the present invention.

Referring now to FIG. 1, there is shown a lens processing system, generally designated 10, for aligning and adhering a front wafer 12 and a back wafer 14 together to form a laminated or composite lens 16 (see FIG. 3) in accordance to prescribed characteristics. The processing system 10 includes a clean air station 18 for aligning and adhering the lens wafers 12, 14 at a predetermined orientation in accordance to a lens prescription. At a curing station 20 the composite lens 16 is compressed and cured under ultraviolet light.

The clean air station 18 includes an alignment wheel 22 disposed below a clean air visor 23, which shields the alignment wheel from falling dust and debris. The alignment wheel 22 provides alignment indicia 24 to enable a user to accurately align the back wafer 14 to the front wafer 12. To align and adhere the lens wafers 12, 14, the front wafer is oriented on a plurality of supports 26 extending upwardly from the alignment wheel 22. The alignment wheel has a scale 28 disposed about its outer perimeter providing indicia 24 representative of 360 degrees of rotation. An adhesive 30 is then applied to the back or concave surface 32 of the front wafer 12 using a glue gun 31. The glue gun 31 includes a stepper motor (not shown) that, when actuated by the user, drives a piston (not shown). The piston then expels adhesive from the glue gun in a controlled, metered manner. The front or convex surface 33 of the back wafer 14 is then placed atop the back surface 32 of the front wafer and aligned in accordance with the prescription characteristics.

The composite lens 16 is then moved to the curing station 20 where the laminated wafers 12, 14 are placed onto a lens pad arm 34. An air bag arm 36, which includes an inflatable membrane 38, is pivotally disposed above the lens pad arm 34. The lens wafers 12, 14 are compressed between the air bag arm 34 and the lens pad arm 36 by inflating or expanding the membrane of the air bag arm with compressed air for a predetermined time period. The compression of the lens wafers 12, 14 controls the gap between the wafers from the center of the lens 16 to its edges to ensure a consistent through-power in the lens. The lens pad arm 34 retaining the composite lens 16 and the air bag arm 36 are then rotated into a chamber 39 of the processing system 10, where the adhesive is cured by ultraviolet light. During the curing process, the air bag arm 36 maintains compression on the lens.

The lens processing system 10 is controlled by a processor (not shown) embedded therein. The user communicates with the processor to control the operation the lens processing system 10 via a user interface 40 having a keypad 42 and display panel 44. The processor steps the user through the lens processing method by displaying prompts to the user and receiving commands from the user via the keypad.

Figure 2:
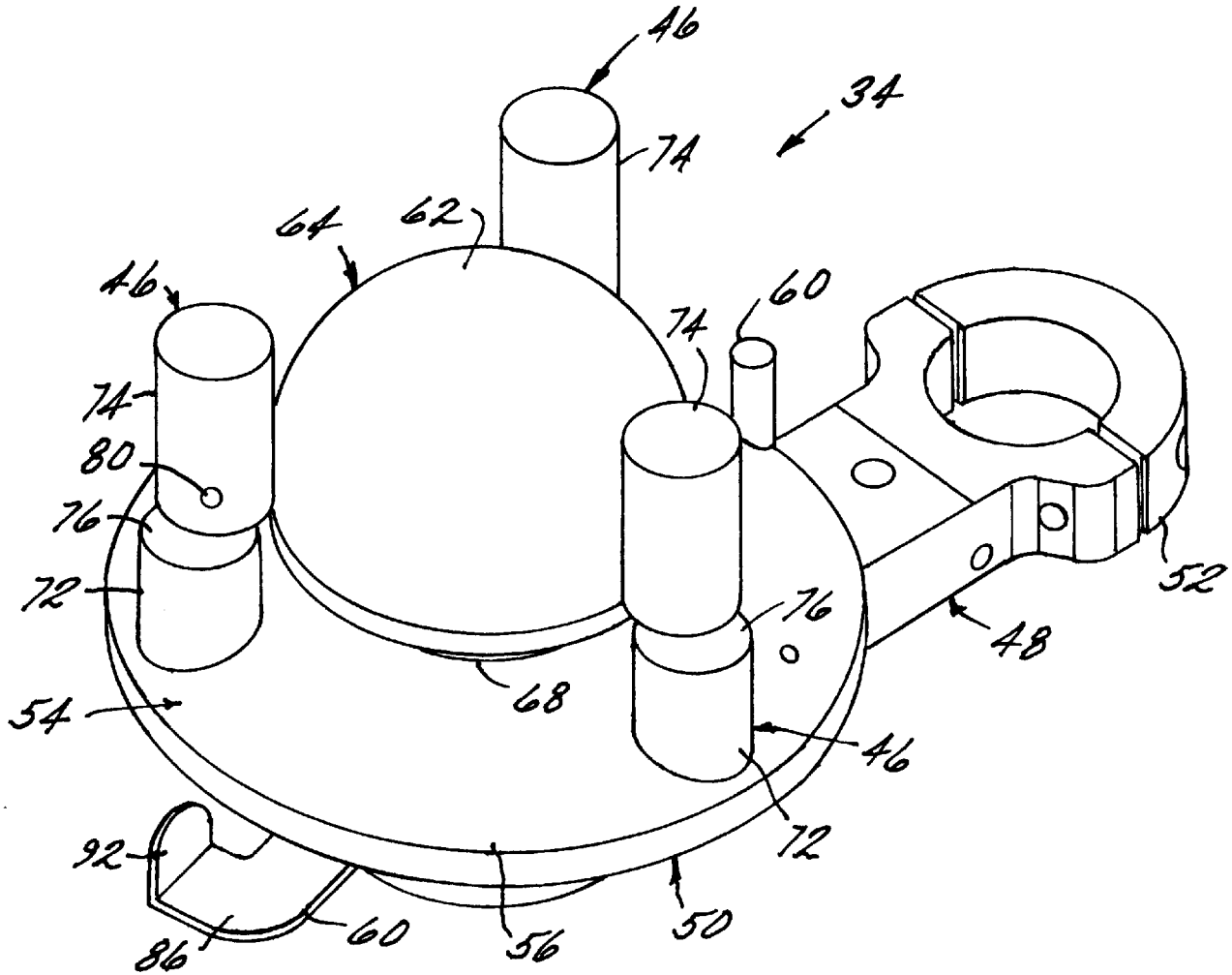
FIG. 2 is a perspective view of a lens pad arm embodying the present invention.
Figure 3:
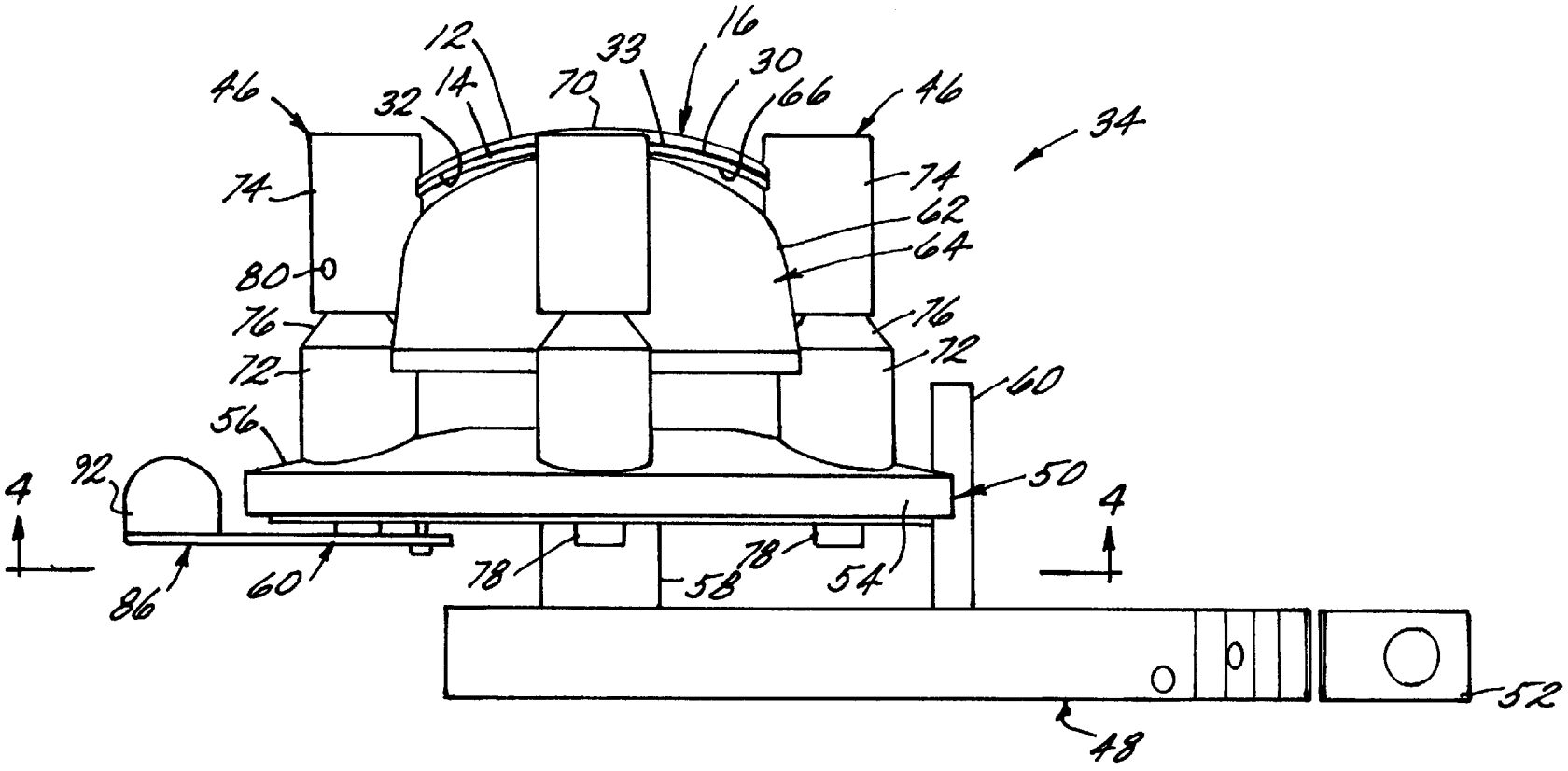
FIG. 3 is a side elevational view of the lens pad of the lens pad arm of FIG. 2.

Turning now to FIGS. 2 and 3, the lens pad arm 34 includes a plurality of adjustable lens retainer pins 46 that enable a plurality of differing composite lenses 16 of various diameters to be retained therein. The lens pad arm 34 comprises a lens support arm 48 to support a lens support assembly 50 that extends upward from one end thereof. A second end of the lens support arm is secured by a collar 52 to a spur gear assembly (not shown) to permit the lens support arm 48 to pivot between a first position within the chamber 39 of the processing system 10 and a second position outside of the chamber. The lens retainer pins 46, preferably three (3) pins, extend upward from a circular base 54 having a tapered upper surface 56. A spacer 58 supports the base above the lens support arm 48 a predetermined distance to provide sufficient clearance to permit the operation of a mechanism 60 to pivot the lens retainer pins 46, as will be described in greater detail hereinafter. The base 54 is further notched at its peripheral surface to receive an index pin 60 that extends upward from the lens support arm 48. The index pin fixedly secures the lens support assembly 50 in a proper orientation to the lens support arm 48. The lens retainer pins 46 are radially spaced substantially 120 degrees apart at equal distances from the axis of the base 54.

A lens pad 62 is centrally disposed on the base 54 of the lens support assembly 50. The lens pad 62 is substantially semi-spherical in shape having an upper convex surface 64. The lens pad is formed of silicone rubber or a similar compliant material to provide a stiff, cushioned surface for supporting the composite lens 16 during the compression and curing stages of the lens forming process. The curvature of the upper convex surface 64 of the lens pad 62 is substantially the same as the curvature of the back surface 66 of the back wafer 14 to support a substantial portion of the composite lens 16. The lens pad is spaced from the upper surface 56 of the base 54 by a standoff 68 so that the height of the upper surface of the lens pad is slightly less than the height of the lens retainer pins 46. The lens retainer pins are adjusted to receive the maximum diameter lens, as will be described hereinafter. The composite lens 16 is placed in the lens support assembly 50 by turning the lens over so that a substantial portion of the back, concave surface 66 of the back wafer 14 engages the lens pad 62. The lens retainer pins 46 are adjusted (or closed) manually or automatically against the outer edges of the composite lens 16 to clamp and center the wafers 12, 14 concentric with the lens pad 62. The upper, convex surface 70 of the front wafer 12 extends above the lens retainer pins 46 to permit the inflatable membrane 37 of the air bag arm 36 to engage and compress the lens wafers 12, 14 of the composite lens 16.

Each lens retainer pin 46 includes a lower pin portion 72 and an upper pin portion 74. Each pin portion 72, 74 is generally cylindrical, however, one will appreciate the pin portions may be of any shape. The lower pin portion 72 has a frusto-conical upper surface 76 (see FIGS. 2 and 3). The upper pin portion 74 is mounted eccentrically to the lower pin portion 72 by a shaft 78 that passes through an axial bore disposed in the lower pin portion. One end of the shaft 78 is fixedly connected, such as by a pin 80 or other fastener, to the upper pin portion 74 offset from the axis thereof to enable the upper pin portion to pivot eccentrically about the lower pin portion. The opposing end of the shaft extends through the bottom surface 82 of the base 54 and connects to a gear 84, as best shown in FIG. 4.

Figure 4:
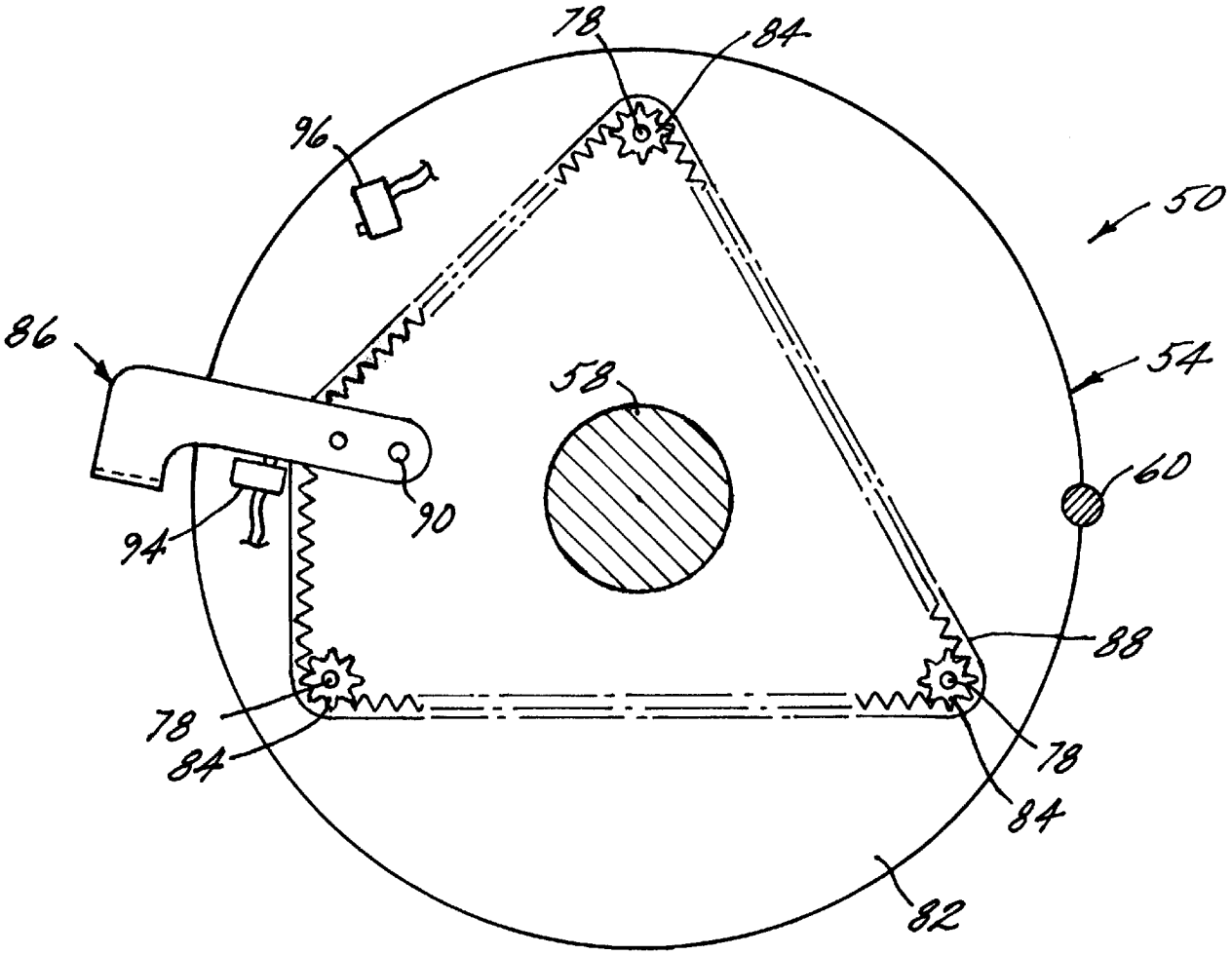
FIG. 4 is a sectional view of the lens pad arm of FIG. 3 taken along the line 4—4.

As best shown in FIG. 4, each of the gears 84 attached to the shafts 78 of the lens retainer pins 46, are interconnected to a pivot arm 86 by a toothed belt 88 meshed with each of the gears. One end of the pivot arm 86 is pivotally mounted at 90 to the lower surface 82 of the base 54. The pivot arm extends radially outward from the outer periphery of the base, providing a handle to permit a user to rotate the gears 84 between a first (closed) position and a second (open) position. The belt 88 may be attached to the pivot arm by a fastener, or alternatively, the belt may engage a gear that is fixed to the pivot arm. The pivot arm has a vertical tab 92 that may act as a position stop for the first position and second position of the pivot arm. These positions of the pivot arm translate to a corresponding first position and second of the upper pin portions 74 of the lens retainer pins 46, as will described hereinafter.

Figure 5:
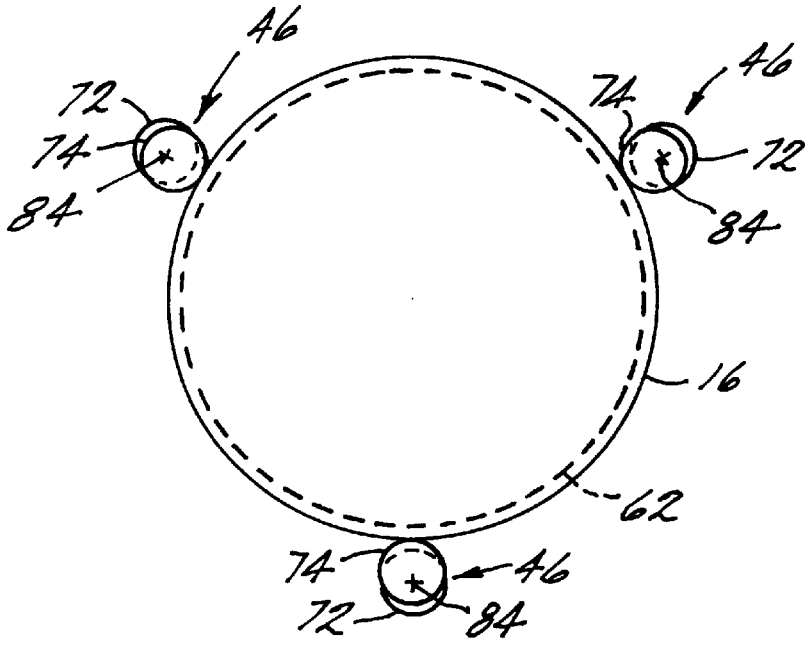
FIG. 5 is a schematic diagram of a plurality of adjustable lens retainer pins oriented in a first position for retaining a lens having a first diameter.
Figure 6:
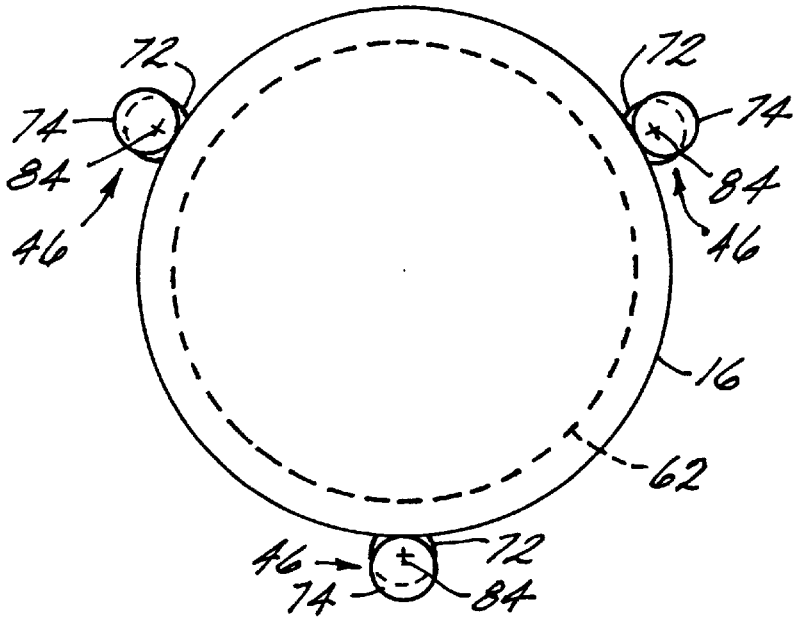
FIG. 6 is a schematic diagram of a plurality of the adjustable lens retainer pins oriented in a second position for retaining a lens having a second diameter.

In the operation of the lens support assembly 50, the pivot arm 86 is rotated in a counterclockwise direction, as shown in FIG. 4, until the vertical tab 92 engages the outer periphery of the base 54. As the pivot arm rotates counterclockwise, the belt simultaneously rotates the gears 78 counterclockwise and each corresponding upper pin portion 74 of the lens retainer pins 46 pivot to the first (closed) position, as shown in FIG. 5. In this first position, the upper pin portion 74 retains the composite lens (approximately 67 mm) centered on the lens pad 64. When the pivot arm 86 is rotated in the clockwise direction, the belt 88 simultaneously rotates each gear 78 clockwise and each corresponding upper pin portion 74 rotates counterclockwise approximately 180 degrees. The pivot arm 86 is rotated until the vertical tab 92 engages the outer periphery of the base 54, which rotates the upper pin portion 74 to the second (open) position, as shown in FIG. 6. In this second position, the upper pin portion 74 of the lens retainer pins 46 retain a composite lens 16 having a greater diameter than the lens 16 shown in FIG. 5 (approximately 75 mm) centered on the lens pad 62. The first and second positions of the upper pin portions 74 of the lens retainer pins 46 represent the upper and lower limits of the lens diameter that the lens support assembly 50 may retain. Therefore, the lens support assembly may retain a lens having a diameter between 67 to 75 mm. One skilled in the art will appreciate that the range of adjustment of the lens retainer pins 46 are dependent on the diameter of the upper pin portions 74 and the offset of the shaft 84 from the axis of the upper pin portion.

Referring to FIG. 4, the pivot mechanism 60 may also include a pair of sensors or switches 94, 96, i.e., micro-switches, to verify that the upper pin portions 74 of the lens retainer pins 46 have rotated to the proper position. For example, when the pivot arm 86 is rotated counterclockwise to the first position, the pivot arm will actuate the corresponding micro-switch 94, which provides a signal to the processor of the processing system or illuminates a lamp to provide a visual confirmation of the position of the retainer pins 46. Similarly, the other micro-switch 96 provides a signal indicative of the proper oriented of the retainer pins in the second position.

Figure 7:
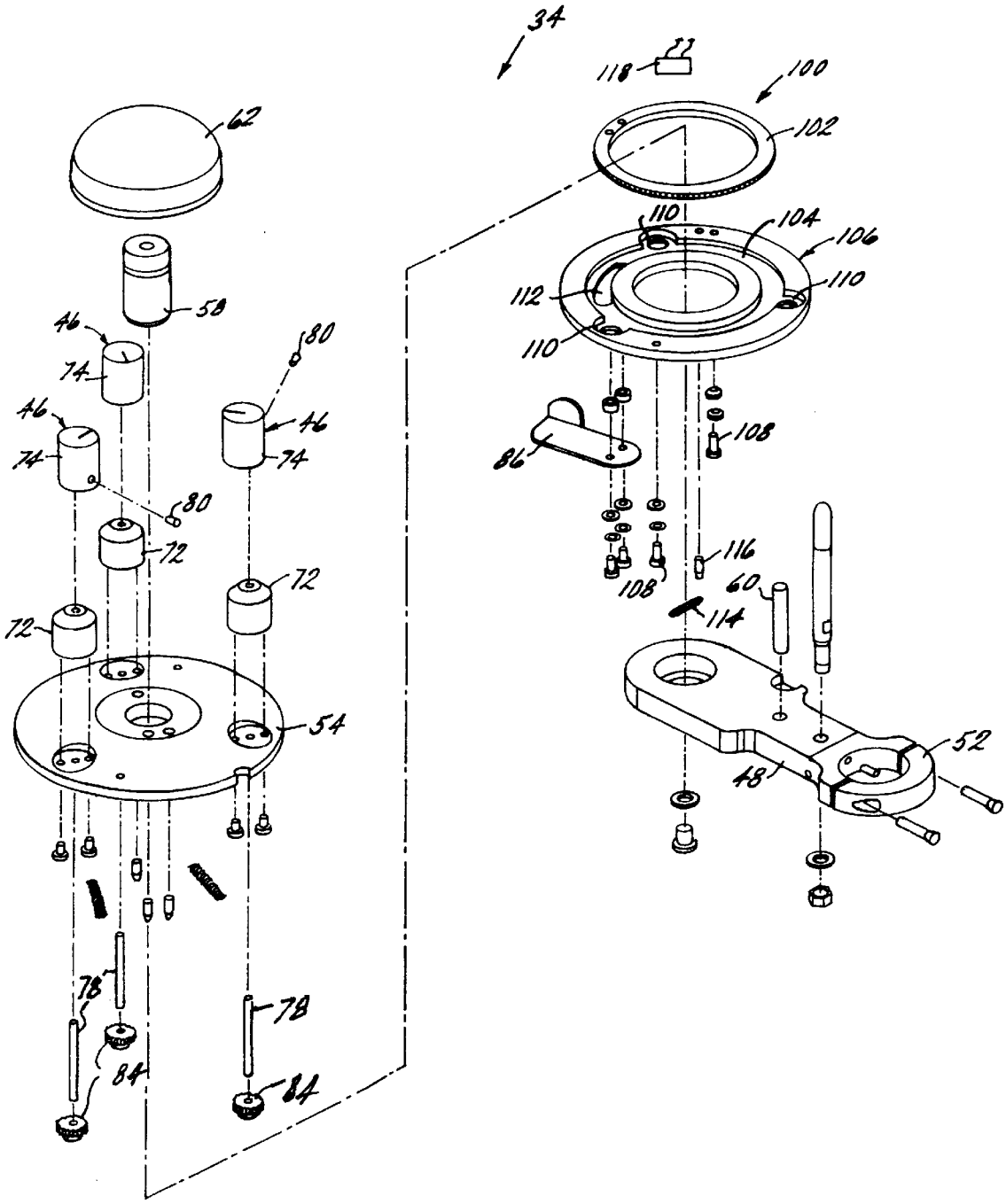
FIG. 7 is an exploded perspective view of an alternative embodiment of a lens pad arm embodying the present invention.

FIG. 7 is illustrative of an alternative embodiment of a pivot mechanism 100 of the present invention, wherein like elements are numbered alike. The pivot mechanism 60 using a toothed belt of FIG. 4 may be substituted a gear-driven pivot mechanism 100 having an annular spur gear 102 meshed with the gears 78 of the lens retainer pins 46. The annular spur gear 102 is retained slidably in an annular groove 104 of a gear housing 106. The gear housing is mounted to the bottom surface of the base 54 by a plurality of fasteners 108. The gear housing 106 further includes a plurality of circular recesses 110 in communication with the annular groove 104, wherein each recess is located to receive a respective gear 78 of the lens retainer pins 46. The pivot arm 86 is attached to and radially extends from the annular spur gear 102 through an arcuate slot 112 in communication with the annular groove 104. The length of the arcuate slot 112 defines the range of adjustment of the upper pin portions 74 of the lens retainer pins 46. For example, when the pivot arm 86 is pivoted to one end of the arcuate slot 112, the annular spur gear 102 rotates the upper pin portions to a first (closed) position as shown in FIG. 5. When the pivot arm 86 is pivoted to the other end of the arcuate slot 112, the annular spur gear 102 rotates the upper pin portions to second (open) position as shown in FIG. 6. The gear driven pivot mechanism 100 may be spring-loaded to automatically return the upper pin portions 74 to the first (closed) position. The spring-loaded upper pin portions therefore provide a clamping action to securely engage and center the wafers 12, 14 on the lens pad 62. The spring-loaded action is provided by an extension spring 114 having one end attached to the pivot arm 86 and another end thereof to a pin 116 mounted to the gear housing 106.

In the operation of the gear-driven pivot mechanism 100, the user pivots the pivot arm 86 to the second (open) position to permit the placement of the lens wafers 12, 14 of varying diameter onto the lens pad 62. As the pivot arm 86 rotates to the second position, the annular gear 102 simultaneously rotates the gears 78 and each corresponding upper pin portion 74 to the second (open) position. The user then places the lens wafers 12, 14 onto the lens pad, as described hereinbefore, and allows the spring-loaded pivot arm 86 to rotate back to the first (closed) position which urges the upper pin portions of the lens retainer pins 46 against the edges of the lens to engage and center the lens wafers on the lens pad 62.

The pivot mechanism 100 may also include an encoder 118 to provide a feedback signal to the processor indicative of the rotational position of the upper pin portions 74 of the lens retainer pins 46. The processor may, for example, process the feedback signal to verify the diameter of the lens wafers 12, 14.

While the operation of the lens retainer pins 46 was described as having a first and second position to retain lens 16, one will appreciate that the rotation of the upper pin portions 74 of the retainer pins may be rotated to a position intermediate the first and second positions to accommodate lens a varying diameters between the range defined by the first and second positions.

While the adjustable lens support assembly 50 has been described with respect to the lens pad arm 34, one skilled in the art will appreciate that the alignment wheel 22 may also include a lens support assembly 50 as described hereinbefore.

While the adjustable lens support assembly 50 has been described with respect to a specific lens processing system 10, one skilled in the art will appreciate that lens support assembly may be used to fixture lens blanks, or lenses that have been previously edged in other devices during the lens manufacturing process.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A lens support assembly for retaining lenses of varying dimensions; said lens support assembly comprising:

a base;

a lens support mounted to the base; and a plurality of lens retainer pins mounted to the base for retaining a lens on the lens support, the lens retainer pins being spaced about the lens support, at least one of the lens retainer pins pivoting about an eccentric pivot between a first pin position and a second pin position.

2. The lens support assembly as defined in claim 1 wherein the lens support includes a lens pad.

3. The lens support assembly as defined in claim 2 wherein the lens pad includes a convex engagement surface for supporting a lens.

4. The lens support assembly as defined in claim 2 wherein the lens pad is formed of a stiff cushion material.

5. The lens support assembly as defined in claim 1 wherein the plurality of lens retainer pins includes at least three lens retainer pins spaced radially approximately 120 degrees.

6. The lens support assembly as defined in claim 1 further comprising a shaft having one end attached to the at least one lens retainer pin.

7. The lens support assembly as defined in claim 1 further comprising a pivot mechanism interconnected the at least one lens retainer pin for rotating the at least one lens retainer pin between the first pin position and the second pin position.

8. The lens support assembly as defined in claim 1 further comprising:

a shaft having a first end attached to the at least one lens retainer pill;

a gear attached to a second end of the shaft;

a pivot arm pivotally mounted to the base; and a belt engaging the gear and pivot arm wherein the at least one lens retainer pin pivots between the first and second pin positions in response to the movement of the pivot arm.

9. The lens support assembly as defined in claim 1 further comprising:

a shaft having a first end attached to the at least one lens retainer pin;

a pin gear attached to a second end of the shaft; and a central gear including a pivot arm extending from the central gear, the central gear engaging the pin gear wherein the at least one lens retainer pin pivots between the first and second pin positions in response to the movement of the pivot arm.

10. The lens support assembly as defined in claim 1 wherein the at least one lens retainer pin comprises a lower pin portion extending from the base and an upper pin portion pivotally mounted eccentrically to the lower pin portion.

11. The lens support assembly as defined in claim 1 wherein the at least one lens retainer pin pivots approximately 180 degrees between the first pin position and the second pin position.

12. The lens support assembly as defined in claim 1 wherein the plurality of lens retainer pins are cylindrical.

13. The lens support assembly as defined in claim 1 further comprising a sensor to provide an electrical signal indicative of the position of the at least one lens retainer pin.

14. The lens support assembly as defined in claim 1 wherein the sensor comprises a micro-switch.

15. The lens support assembly as defined in claim 1 further comprising;

a first sensor to provide an electrical signal indicative of the position of the at least one lens retainer pin disposed in the first pin position; and a second sensor to provide an electrical signal indicative of the position of the at least one lens retainer pin disposed in the second pin position.

16. The lens support assembly as defined in claim 1 wherein the sensor comprises an encoder.

17. The lens support assembly as defined in claim 1 wherein the at least one lens retainer pin disposed in the first position retains a lens having a first diameter and the at least one lens retainer pin disposed in the second position retains a lens having a second diameter, the second diameter being greater than the first diameter.

18. The lens support assembly as defined in claim 7 wherein the pivot mechanism further comprises a spring for urging the at least one lens retainer pin to the first pin position to engage the lens.

19. The lens support assembly as defined in claim 1 wherein each of the plurality of lens retainer pins pivot about an eccentric pivot to between a first pin position and second pin position.

20. The lens support assembly as defined in claim 19 further comprising a pivot mechanism for rotating simultaneously the plurality of lens retainer pins between the first pin position and the second pin position.

21. The lens support assembly as defined in claim 19 wherein each lens retainer pin comprises:

a shaft having a first end attached to the at least one lens retainer pin; and a gear attached to a second end of the shaft.

22. The lens support assembly as defined in claim 21 further comprising:

a pivot arm pivotally mounted to the base; and a belt engaging each gear and pivot arm wherein the lens retainer pins pivot between the first and second pin positions in response to the movement of the pivot arm.

23. The lens support assembly as defined in claim 21 further comprising:

a pivot arm pivotally mounted to the base; and a gear engaging each gear and pivot arm wherein the lens retainer pins pivot between the first and second pin positions in response to the movement of the pivot arm.

24. The lens support assembly as defined in claim 23 further comprising:

a spring for urging the lens retainer pins to the first pin position to clamp the lens therebetween.

25. The lens support assembly as defined in claim 19 further comprising a pivot mechanism for rotating simultaneously the plurality of lens retainer pins between the first pin position and the second pin position to center the lens on the lens support.

* * * * *